US010393069B2

(12) United States Patent
Miyauchi

(10) Patent No.: US 10,393,069 B2
(45) Date of Patent: Aug. 27, 2019

(54) FUEL SUPPLY APPARATUS INCLUDING A PRESSURE REDUCTION PUMP FOR GENERAL PURPOSE ENGINE

(71) Applicant: HONDA MOTOR CO., LTD., Tokyo (JP)

(72) Inventor: Tomohiro Miyauchi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/455,439

(22) Filed: Mar. 10, 2017

(65) Prior Publication Data

US 2017/0268461 A1 Sep. 21, 2017

(30) Foreign Application Priority Data

Mar. 15, 2016 (JP) ..... 2016-051529

(51) Int. Cl.

| | |
|---|---|
| ***F02M 7/127*** | (2006.01) |
| ***F02M 35/04*** | (2006.01) |
| ***F04B 45/04*** | (2006.01) |
| ***F02M 7/11*** | (2006.01) |
| *F02M 35/024* | (2006.01) |
| *F02M 35/08* | (2006.01) |
| *F02M 5/00* | (2006.01) |
| *F02M 17/34* | (2006.01) |

(52) U.S. Cl.

CPC ..... *F02M 7/127* (2013.01); *F02M 7/11* (2013.01); *F02M 35/044* (2013.01); *F04B 45/04* (2013.01); *F02M 5/00* (2013.01); *F02M 17/34* (2013.01); *F02M 35/024* (2013.01); *F02M 35/08* (2013.01)

(58) Field of Classification Search

CPC ..... F02M 7/11–133

USPC ..... 123/701; 261/23.2

See application file for complete search history.

(56) References Cited

U.S. PATENT DOCUMENTS 3,742,924 A * 7/1973 Bachle ..... F02D 9/00 123/676
4,039,638 A * 8/1977 Hill ..... F02M 7/11 123/438
4,191,149 A * 3/1980 Dutta ..... F02D 41/1439 123/512

(Continued)

FOREIGN PATENT DOCUMENTS

JP 60-249655 12/1985

OTHER PUBLICATIONS

European Search Report dated Jun. 12, 2017, 7 pages.

*Primary Examiner* — Erick R Solis
*Assistant Examiner* — Robert A Werner
(74) *Attorney, Agent, or Firm* — Rankin, Hill & Clark LLP

(57) ABSTRACT

A fuel supply apparatus for a general purpose engine includes a carburetor provided in an air intake line extending from an air cleaner to the general purpose engine, a pressure reduction connection channel connected to a float chamber of the carburetor and the air cleaner, a control valve provided in the pressure reduction connection channel, a pressure reduction pump provided in the pressure reduction connection channel and sucking the float chamber to reduce the pressure therein, an air fuel ratio sensor detecting the air fuel ratio of an exhaust gas discharged from the general purpose engine, and a control unit controlling the opening degree of the control valve based on a detection signal of the air fuel ratio sensor.

1 Claim, 2 Drawing Sheets

(56) References Cited

U.S. PATENT DOCUMENTS

| | | | | | |
|---|---|---|---|---|---|
| 4,363,209 | A * | 12/1982 | Atago | F01N 3/22 | 123/701 |
| 5,299,551 | A * | 4/1994 | Tofel | F02M 7/11 | 123/701 |
| 5,309,889 | A * | 5/1994 | Tofel | F02M 7/11 | 123/682 |
| 5,345,912 | A * | 9/1994 | Svensson | F02D 35/0053 | 123/438 |
| 7,263,981 | B2 * | 9/2007 | Woody | F02M 5/14 | 123/198 DB |
| 7,775,194 | B2 * | 8/2010 | Kono | F02M 5/12 | 123/198 DB |

* cited by examiner

FUEL SUPPLY APPARATUS INCLUDING A PRESSURE REDUCTION PUMP FOR GENERAL PURPOSE ENGINE

CROSS-REFERENCE TO RELATED APPLICATION

This application is based upon and claims the benefit of priority from Japanese Patent Application No. 2016-051529 filed on Mar. 15, 2016, the contents of which are incorporated herein by reference.

BACKGROUND OF THE INVENTION

Field of the Invention

The present invention relates to a technique of improving a fuel supply apparatus for a general purpose engine.

Description of the Related Art

For example, Japanese Laid-Open Patent Publication No. 60-249655 discloses a typical fuel supply apparatus for an engine. The fuel supply apparatus for the engine includes a negative pressure pipe extending from a carburetor to a combustion chamber of the engine, a connection pipe connecting the negative pressure pipe and a float chamber of the carburetor, a control valve such as a solenoid valve provided in this connection pipe, an air fuel ratio sensor for detecting the air fuel ratio of an exhaust gas discharged from a combustion chamber of the engine, and a control unit for controlling the control valve based on a detection signal of the air fuel ratio sensor.

When the control valve is closed, the float chamber is placed in a basic state (non-depressurized state) where the pressure in the float chamber is not reduced. When the control valve is opened, the pressure difference between the negative pressure pipe extending from the carburetor to the combustion chamber and the float chamber of the carburetor becomes small. As a result, it is possible to control the air fuel ratio in the lean direction, from the air fuel ratio in the basic state where the float chamber is not depressurized.

However, the pressure reduction level in the float chamber is affected by the negative pressure of the negative pressure pipe extending from the carburetor to the combustion chamber. That is, the pressure in the float chamber is simply decreased to the level of the negative pressure of the negative pressure pipe. There is a room of improvement in controlling the air fuel ratio of the exhaust gas from the engine much more accurately and much more finely.

SUMMARY OF THE INVENTION

A general object of the present invention is to provide a technique of a fuel supply device for a general purpose engine in which it is possible to control the air fuel ratio of an exhaust gas from the general purpose engine much more accurately and much more finely.

According to the present invention, a fuel supply apparatus for a general purpose engine includes a carburetor provided in an air intake line extending from an air cleaner to an air intake port of the general purpose engine, a pressure reduction connection channel connecting a float chamber of the carburetor and the air cleaner, a control valve provided in the pressure reduction connection channel, and controllable in a manner that the control valve can be fully closed, and that an opening degree of the control valve can be changed continuously, a pressure reduction pump provided in the pressure reduction connection channel, and configured to suck the float chamber to reduce a pressure in the float chamber, an air fuel ratio sensor configured to detect an air fuel ratio of an exhaust gas discharged from a combustion chamber of the general purpose engine, and a control unit configured to control the opening degree of the control valve based on a detection signal of the air fuel ratio sensor.

The present invention is based on the premise that, the fuel supply amount of the carburetor in the basic state (non-depressurized state) where the pressure in the float chamber is not reduced is set to be rich in comparison with the stoichiometric air fuel ratio. The air intake port of the air cleaner is opened to the atmospheric air. The float chamber of the carburetor is connected to the air cleaner of the air intake line by the pressure reduction connection channel. The control valve and the pressure reduction pump are provided in the pressure reduction connection channel. The float chamber is sucked by the pressure reduction pump to reduce the pressure in the float chamber.

In the structure, by suitably setting the suction capability of the pressure reduction pump, it is possible to optimize the pressure reduction level in the float chamber. That is, the pressure reduction level in the float chamber is not affected by the negative pressure of the air intake line extending from the carburetor to the combustion chamber of the general purpose engine. Further, the valve opening degree of the control valve in the pressure reduction connection channel is based on the air fuel ratio of the exhaust gas detected by the air fuel ratio sensor. By continuously controlling the valve opening degree, it is possible to continuously regulate the flow rate of the air flowing through the pressure reduction connection channel. As a result it is possible to continuously control the pressure reduction speed in the float chamber.

Further, by the pressure reduction pump and the control valve, it is possible to continuously regulate the pressure reduction level and the pressure reduction speed in the float chamber. That is, it is possible to continuously regulate the pressure difference between the float chamber and the Venturi part of the carburetor. Further, the air fuel ratio can be controlled continuously in the lean direction, from the air fuel ratio in the basic state (non-depressurized state) where the pressure in the float chamber is not reduced.

As described above, by the pressure reduction pump and the control valve, it is possible to control the pressure reduction level in the float chamber finely. Since it is possible to control the pressure difference between the float chamber and the Venturi part of the carburetor quickly and finely, it is possible to control the air fuel ratio of the exhaust gas much more accurately and much more finely. Further, based on the air fuel ratio of the exhaust gas detected by the air fuel sensor, it is possible to implement the feedback control of the valve opening degree of the control valve.

Further, during the feedback control, even if the load of the general purpose engine varies, by fully closing the control valve by the control unit, it is possible to quickly restore the float chamber to the basic state where the pressure therein is not reduced. As a result, it is possible to change the air fuel ratio quickly in response to load changes of the general purpose engine.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
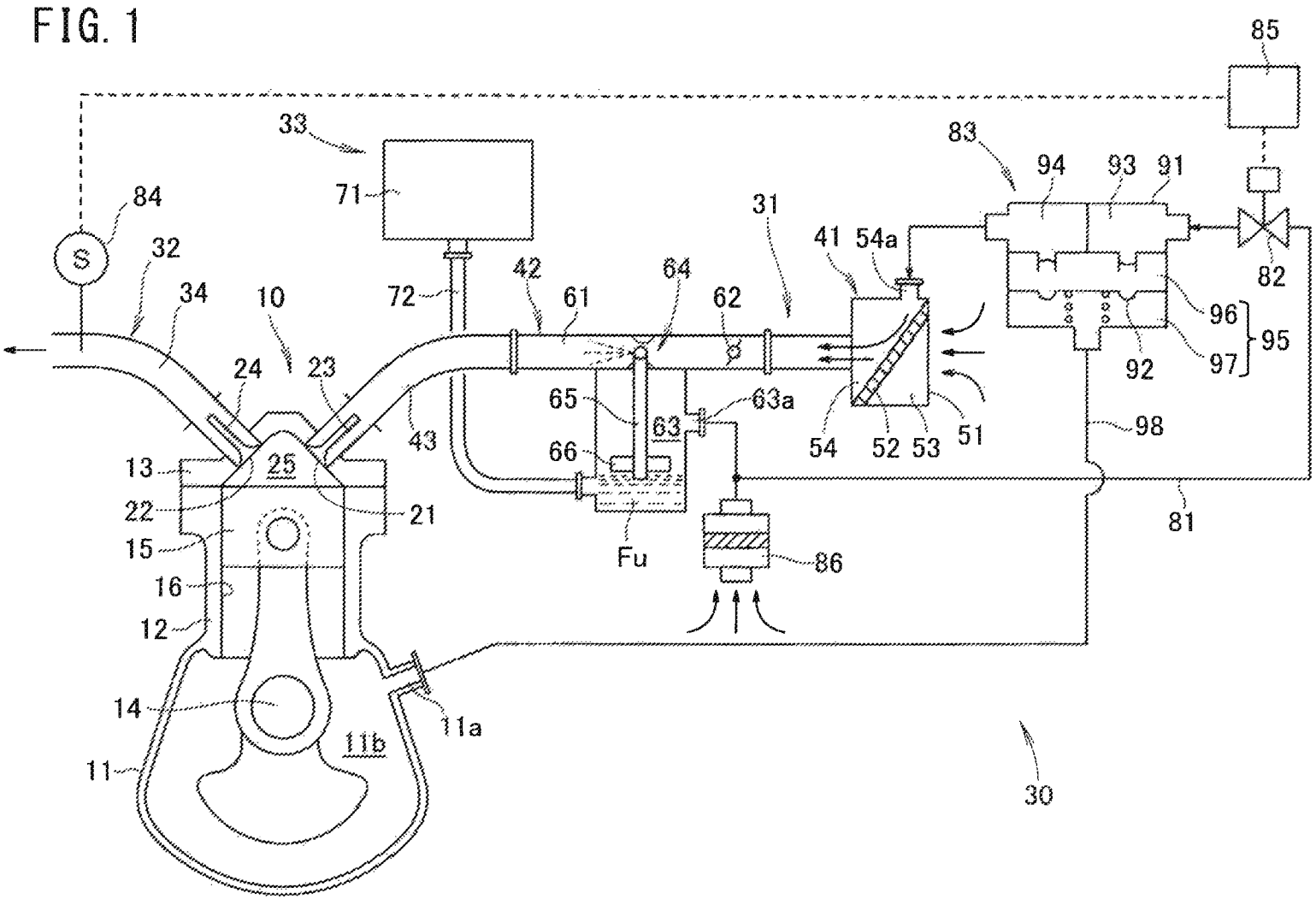
FIG. 1 is a schematic diagram showing a fuel supply apparatus for a general purpose engine according to the present invention.

A general purpose engine 10 is, e.g., mounted in a general purpose machine such as an outboard engine or a work machine. As shown in FIG. 1, the general purpose engine 10 includes a crankcase 11, a cylinder block 12, a head cover 13, a crank shaft 14, and a piston 15. The cylinder block 12 has a cylinder 16 where the piston 15 moves back and forth in a reciprocal manner. The head cover 13 has an air intake port 21 and an air discharge port 22. The air intake port 21 is opened/closed by an air intake valve 23. The air discharge port 22 is opened/closed by an air discharge valve 24.

FIG. 1 schematically shows the general purpose engine 10, a fuel supply apparatus 30 for use of the general purpose engine 10, i.e., an air intake line 31, an air discharge line 32, and a fuel supply line 33.

The air intake line 31 is connected to the air intake port 21. The air discharge line 32 is connected to the air discharge port 22. The air intake line 31 has an air cleaner 41, a carburetor 42, and an intake manifold 43. A connection port 11*a* is formed in the crankcase 11.

The air cleaner 41 includes a cleaner box 51, an air filter 52 placed in the cleaner box 51, and a dust chamber 53 and a clean chamber 54 formed by dividing the inside of the cleaner box 51 by the air filter 52. The dust chamber 53 is a space formed in the air cleaner 41, i.e., formed in the cleaner box 51. The external air (air before filtered by the air filter 52) is supplied into the dust chamber 53. The clean chamber 54 is a space formed in the air cleaner 41, i.e., formed in the cleaner box 51. After the air in the dust chamber 53 is filtered by the air filter 52, the filtered air flows into the clean chamber 54. The clean chamber 54 has a connection port 54*a* (connection port 54*a* of the air cleaner 41).

Figure 2:
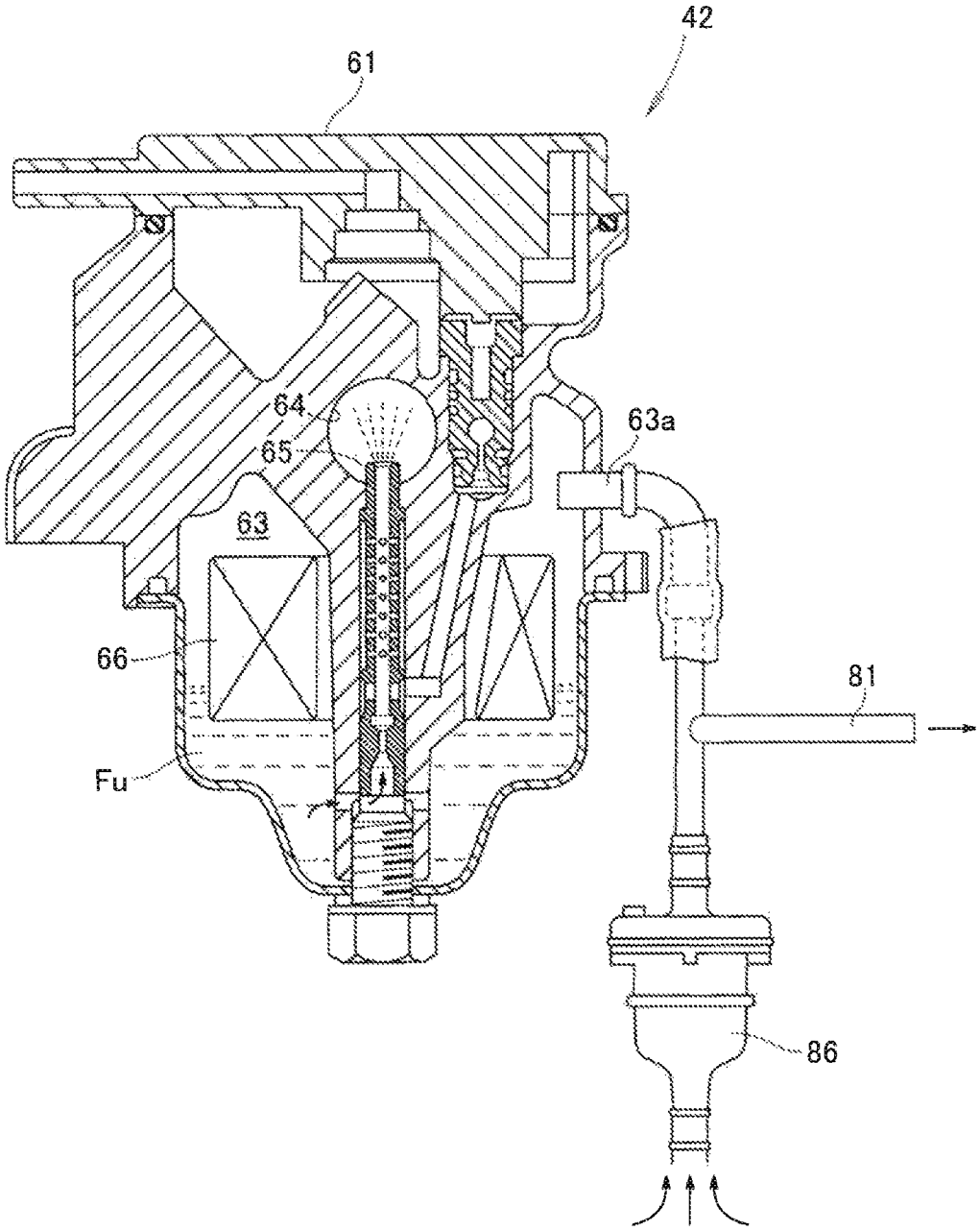
FIG. 2 is a cross sectional view showing a carburetor shown in FIG. 1.

The carburetor 42 is present in the air intake line 31 extending from the air cleaner 41 to the air intake port 21 of the general purpose engine 10. As shown in FIGS. 1 and 2, the carburetor 42 includes a throttle body 61, a throttle valve 62 provided in the throttle body 61, a float chamber 63 provided below the throttle body 61, a spray nozzle 65 for spraying a fuel Fu in the float chamber 63 toward a Venturi part 64 of the throttle body 61. The fuel atomized by the carburetor 42 and the combustion air supplied from the air cleaner 41 are supplied to a combustion chamber 25 of the general purpose engine 10. The float chamber 63 has a float 66 for detecting a level of the fuel Fu stored in the float chamber 63. A ventilation port 63*a* is provided above an upper limit level of the fuel Fu stored in the float chamber 63.

The fuel supply line 33 includes a fuel tank 71 and a fuel supply pipe 72 for supplying the fuel from the fuel tank 71 to the float chamber 63.

Further, the fuel supply apparatus 30 for the general purpose engine includes the carburetor 42, a pressure reduction connection channel 81, a control valve 82, a pressure reduction pump 83, an air fuel ratio sensor 84, and a control unit 85.

The pressure reduction connection channel 81 connects the float chamber 63 of the carburetor 42 and the air cleaner 41. Specifically, the pressure reduction connection channel 81 connects the connection port 54*a* of the air cleaner 41 and the ventilation port 63*a* of the float chamber 63. The control valve 82 and the pressure reduction pump 83 are provided in the pressure reduction connection channel 81. For example, preferably, in the pressure reduction connection channel 81, the pressure reduction pump 83 is provided closer to a side of the connection port 54*a* of the air cleaner 41 than the control valve 82. Further, the pressure reduction connection channel 81 is branched at a position between the ventilation port 63*a* of the float chamber 63 and the control valve 82, and opened to the atmospheric air through an air filter 86. That is, the ventilation port 63*a* of the float chamber 63 is connected to the air cleaner 41 by the pressure reduction connection channel 81, and opened to the atmospheric air.

The control valve 82 is controllable in a manner that the control valve 82 can be fully closed or the valve opening degree of the control valve 82 can be changed continuously. The control valve 82 is so called an electric operated valve. For example, by an electric motor such as a stepping motor, the control valve 82 is driven in a manner that the control valve 82 can be fully closed, and fully opened, and the control valve 82 is driven (linearly driven) in a manner that the valve opening degree thereof can be changed continuously.

The pressure reduction pump 83 is configured to suck the float chamber 63 to reduce the pressure in the float chamber 63. Preferably, the pressure reduction pump 83 is a diaphragm pump which is operated in response to the negative pressure and the positive pressure generated alternately in an inner space 11*b* (crank chamber 11*b*) of the crankcase 11 of the general purpose engine 10. Hereinafter, the pressure reduction pump 83 will be referred to as the "diaphragm pump 83" as necessary.

The diaphragm pump 83 includes a housing 91 and a diaphragm 92. The housing 91 is divided into an intake chamber 93, a discharge chamber 94, and a diaphragm chamber 95. The diaphragm 92 divides the diaphragm chamber 95 into a pump chamber 96 and an air chamber 97. The air chamber 97 is connected to the connection port 11*a* of the crankcase 11 by a connection pipe 98. Further, the diaphragm 92 is operated in response to the negative pressure and the positive pressure generated alternately in the crank chamber 11*b* to perform pumping operation. As a result, when the control valve 82 is not fully closed, the diaphragm 92 sucks the air in the float chamber 63 to reduce the pressure in the float chamber 63.

As described above, the diaphragm pump 83 (pressure reduction pump 83) can be driven utilizing the internal pressure of the crankcase 11. It is sufficient to adopt simple structure implemented only by providing the connection pipe 98 connecting the crankcase 11 and the diaphragm pump 83.

The air fuel ratio sensor 84 detects the air fuel ratio of the exhaust gas discharged from the combustion chamber 25 of the general purpose engine 10. For example, the air fuel ratio sensor 84 is an $O_2$ sensor. For example, the air fuel ratio sensor 84 is provided at an exhaust manifold 34 of the air discharge line 32.

Based on a detection signal from the air fuel ratio sensor 84, the control unit 85 controls the control valve 82 in a manner that the control valve 82 is fully opened, fully closed, or the opening angel of the control valve 82 is changed continuously (linear control). That is, the control unit 85 implements feedback control of the valve opening degree of the control valve 82 based on the air fuel ratio of the exhaust gas detected by the air fuel ratio sensor 84.

As described above, in the embodiment of the present invention, the fuel supply apparatus 30 for the general purpose engine is based on the premise that the fuel supply amount of the carburetor 42 in the basic state (non-depressurized state) where the pressure in the float chamber 63 is not reduced is set to be rich in comparison with the stoichiometric air fuel ratio.

The air intake port of the air cleaner 41 (air intake port of the dust chamber 53) is opened to the atmospheric air. The float chamber 63 of the carburetor 42 is connected to the air cleaner 41 of the air intake line 31 by the pressure reduction connection channel 81. The control valve 82 and the pressure reduction pump 83 are provided in the pressure reduction connection channel 81. The float chamber 63 is sucked by the pressure reduction pump 83 to reduce the pressure in the float chamber 63.

In the structure, by suitably setting the suction capability of the pressure reduction pump 83, it is possible to optimize the pressure reduction level in the float chamber 63. That is, the pressure reduction level in the float chamber 63 is not affected by the negative pressure of the air intake line 31 extending from the carburetor 42 to the combustion chamber 25 of the general purpose engine 10. Further, the valve opening degree of the control valve 82 in the pressure reduction connection channel 81 is based on the air fuel ratio of the exhaust gas detected by the air fuel ratio sensor 84. By continuously controlling the valve opening degree, it is possible to continuously regulate the flow rate of the air flowing through the pressure reduction connection channel 81. As a result, it is possible to continuously control the pressure reduction speed in the float chamber 63.

Further, by the pressure reduction pump 83 and the control valve 82, it is possible to continuously regulate the pressure reduction level and the pressure reduction speed in the float chamber 63. That is, it is possible to continuously regulate the pressure difference between the float chamber 63 and the Venturi part 64 of the carburetor 42. Further, the air fuel ratio can be controlled continuously in the lean direction, from the air fuel ratio in the basic state (non-depressurized state) where the pressure in the float chamber 63 is not reduced.

As described above, by the pressure reduction pump 83 and the control valve 82, it is possible to control the pressure reduction level in the float chamber 63 finely. Since it is possible to control the pressure difference between the float chamber 63 and the Venturi part 64 of the carburetor 42 quickly, and finely, it is possible to control the air fuel ratio of the exhaust gas much more accurately and much more finely.

Further, based on the air fuel ratio of the exhaust gas detected by the air fuel ratio sensor 84, it is possible to implement the feedback control of the valve opening degree of the control valve 82. Further, in the case where it is possible to perform feedback operation near the stoichiometric air fuel ratio, by providing three way catalyst in the air discharge line 32, it is possible to easily purify the exhaust gas. Further, since the pressure reduction level in the float chamber 63 is controlled, it is possible to control both of the fuel systems, i.e., the main system (throttle system) and the idling system (slow system) at the same time.

Further, during the feedback control, even if the load of the general purpose engine 10 varies, by fully closing the control valve 82 by the control unit 85, it is possible to quickly restore the float chamber 63 to the basic state where the pressure therein is not reduced. As a result, it is possible to change the air fuel ratio quickly in response to load changes of the general purpose engine 10.

The fuel supply apparatus 30 for the general purpose engine according to the present invention is suitably adopted in a general purpose machine such as an outboard engine or a work machine.

While the invention has been particularly shown and described with reference to the a preferred embodiment, it will be understood that variations and modifications can be effected thereto by those skilled in the art without departing from the scope of the invention as defined by the appended claims.

What is claimed is:

1. A fuel supply apparatus for a general purpose engine, the fuel supply apparatus comprising:

a carburetor provided in an air intake line extending from an air cleaner to an air intake port of the general purpose engine;

a pressure reduction connection channel connecting a float chamber of the carburetor and the air cleaner;

a control valve provided in the pressure reduction connection channel, the control valve being controllable in a manner that the control valve can be fully closed, and that an opening degree of the control valve can be changed continuously;

a pressure reduction pump provided in the pressure reduction connection channel and configured to suck the float chamber to reduce a pressure in the float chamber;

an air fuel ratio sensor configured to detect an air fuel ratio of an exhaust gas discharged from a combustion chamber of the general purpose engine; and a control unit configured to control the opening degree of the control valve based on a detection signal of the air fuel ratio sensor, wherein the pressure reduction pump comprises a diaphragm pump operated in response to a negative pressure and a positive pressure generated alternately inside a crankcase of the general purpose engine, wherein the diaphragm pump includes a housing and a diaphragm, the housing is divided into an intake chamber, a discharge chamber, and a diaphragm chamber, the diaphragm divides the diaphragm chamber into a pump chamber and an air chamber, and the air chamber is connected to a connection port of the crankcase of the general purpose engine by a connection pipe, wherein the pressure reduction connection channel is opened to the atmospheric air through an air filter, wherein the control valve is provided upstream of the intake chamber of the pressure reduction pump and downstream of each of the float chamber and the air filter, wherein the intake chamber and the float chamber are connected by the pressure reduction connection channel, and the discharge chamber is connected to the air cleaner upstream of the air intake line.

* * * * *